US005812915A

United States Patent [19]

Farkash

[11] Patent Number: 5,812,915

[45] Date of Patent: Sep. 22, 1998

[54] PRESS FIT FILL PLUGS WITH UNIFORM SEALING ABILITY

[75] Inventor: Ron H. Farkash, Rochester, N.Y.

[73] Assignee: Xerox Corporation, Stamford, Conn.

[21] Appl. No.: 966,291

[22] Filed: Nov. 7, 1997

[51] Int. Cl.[6] ..... G03G 15/08

[52] U.S. Cl. ..... 399/262; 399/119; 399/106; 222/DIG. 1; 222/522

[58] Field of Search ..... 399/106, 120, 399/262, 263, 119; 222/DIG. 1, 522, 556

[56] References Cited

U.S. PATENT DOCUMENTS

| | | | |
|---|---|---|---|
| 4,878,603 | 11/1989 | Ikesue et al. | 222/167 |
| 4,941,022 | 7/1990 | Ohmura et al. | 355/260 |
| 4,990,964 | 2/1991 | Kraehn | 355/260 |
| 5,057,872 | 10/1991 | Saijo et al. | 355/260 |
| 5,089,854 | 2/1992 | Kaieda et al. | 355/260 |
| 5,200,787 | 4/1993 | Nishiguchi | 355/298 |
| 5,280,324 | 1/1994 | Ono et al. | 222/DIG. 1 |
| 5,379,922 | 1/1995 | Paradoski | 222/522 X |
| 5,383,502 | 1/1995 | Fisk et al. | 355/260 |
| 5,455,662 | 10/1995 | Ichikawa et al. | 355/260 |
| 5,495,323 | 2/1996 | Meetze, Jr. | 355/260 |
| 5,729,797 | 3/1998 | Okada et al. | 399/262 |
| 5,765,079 | 6/1998 | Yoshiki et al. | 399/262 X |

*Primary Examiner*—R. L. Moses
*Attorney, Agent, or Firm*—John S. Wagley

[57] ABSTRACT

A plug for use in plugging an aperture in a container for storing a supply of particles for use in a developer unit of an electrophotographic printing machine is provided. The plug includes a base, a rim extending from the periphery of the base. The rim may cooperate with the aperture. The plug further includes a stem extending from the base and spaced from the rim, so that the rim may conform to the aperture and thereby seal the aperture without being affected by the handle.

25 Claims, 10 Drawing Sheets

PRESS FIT FILL PLUGS WITH UNIFORM SEALING ABILITY

The present invention relates to a developer apparatus for electrophotographic printing. More specifically, the invention relates to a container for storing toner.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable marking particles typically in the form of a powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

In an electrophotographic printer as the toner within the developer material is transferred to the photoreceptor and eventually to the copy paper, this used toner must be replaced. The electrophotographic printer thus includes a toner container or cartridge from which fresh toner is dispensed into the machine. When using two component developer, a portion of the carrier granules will eventually deteriorate. Additional new carrier granules may be added to the machine to replace the deteriorated granules. The toner container or cartridge may thus alternatively store a mixture including a small quantity of carrier granules in addition to the toner. To provide for a small compact toner cartridge and to provide for a toner cartridge in which the opening to the cartridge may be easily removed, the toner cartridge typically has a compact shape with a small opening from which the toner is dispensed.

Traditionally when all the toner within the container had been consumed, additional toner was supplied to the machine by pouring toner from a separate refilling bottle into the container. This method permitted many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary, time consuming, and expensive.

Recently, machines have been supplied with replaceable toner containers or cartridges to avoid some of the problems associated with spilling toner during refilling. While missing the opening of the container during filling and spilling large quantities of toner is alleviated by replaceable toner containers, spillage can occur from the old container during removal and from the new container during installation.

Toner in the toner container or cartridge must be fed therefrom to the latent image to effectuate development. Typically, toner containers are located with their openings in the bottom of the container whereby they may be emptied by gravity. In attempts to make inexpensive and compact electrophotographic printers and to minimize space and related costs, however, the shape of the toner container may not be conducive to a bottom opening or to an unassisted emptying of the container. This is particularly true for wide format copiers and printers. When the opening is not in the bottom or the geometry of the container does not promote the free flow of all the contents, a mechanism must be provided for removing the toner therefrom. While the demand for toner remains fairly constant, these mechanisms expel large quantities of toner when the container is full and progressively smaller amounts as the container empties. Typically the toner containers are cylindrical and the toner is removed therefrom by rotating the container and/or a member within the container, such as a spiral wire, Toner containers are typically filled with toner either single component toner or two component developer material including a marking particles, or toner, as well as, a carrier in the form of a spherical granules. It is important that toner containers to be filled in production filling operations include a large opening for the rapid filling of the toner container. To permit rapid and complete filling of the toner container, typically the longitudinal or long axis of the toner container is vertically oriented when filling the containers. Often the containers have a cylindrical shape or a circular cross section. It should be appreciated, however, that the invention later described may be practiced for any type of toner container. Typically thus the toner container includes a large circular hole through which toner is added. This hole must then be plugged during shipment and for later use of the container.

These large openings are typically sealed by the use of a plug. The plug may be glued or welded to the toner container to provide for a quick and simple sealing of this large filling hole a tapered plug is often used. Typically these plugs are made of plastic and are fitted into the opening. The plugs have a tapered cylindrical OD to which the plugs are press fitted into the cylindrical opening.

The use of a plastic plug to fill the filling hole has numerous problems. The low density polyethylene or polypropylene typically used for commercially available, plastic plugs leak toner through the openings. A method to prevent the leaking of the toner is to add tape or sealant between the plug and the opening. The use of tape or adhesive adds to the cost of the toner container as well as increased labor to assemble the adhesive or tape to the container. Further, the use of an adhesive or tape affects the recyclability of the toner container.

The toner containers may require rotation to advance the toner particles to a dispense opening. For example, the toner container may include an external molded spiral which urges the particles to one end of the container. The spherical grooves requires that the toner container be rotated. Also the toner container may include a slidable door or opening through which in the periphery of the container through which toner is dispensed. The slidable cover for the dispensing hole may require rotation of the toner container to open and close the dispensing hole. Features thus have been added to the toner container in the form of a handle to permit rotation of the toner container.

Attempts have been made to add the handle or rotation feature for the toner container to the plug. When utilizing low density polyethylene or polypropylene as the plug material the low density polyethylene or polypropylene does not have enough strength to transfer the torque to the container. Furthermore an effective seal can not be had between the low density polyethylene or polypropylene plug and the toner container to permit the rotation of the bottle.

Plugs typically are in the form of a cylindrical tube closed on one end thereof. Typically a handle is located and supported from the outer edges of the rim of the plug. This configuration of the plug creates non-uniform flexing of the plug when inserted into a toner container. This causes the plug to leak in the direction opposed to the handle. Furthermore, to reduce cost and weight, the handle typically is hollow and has an open or cored side adjacent the bottom of the plug. The coring of the handle at the base of the plug further causes the plug to have a non-uniform cross section and as such causes it to non-uniformly flex. This further complicates the ability of the plug to seal against the fill opening of the container. Typically the handle is used to orient the body of the toner container when installing the container into the printing machine. Thus the plug must be oriented properly with respect to the base of the container. This oriented assembly requires a manual assembly even in a production environment where automatic assembly will reduce costs, improve productivity and is typically desired.

The following disclosures may be relevant to various aspects of the present invention:

U.S. Pat. No. 5,495,323

Patentee: Meetze

Issue Date: Feb. 27, 1996

U.S. Pat. No. 5,455,662

Patentee: Ichikawa et al.

Issue Date: Oct. 3, 1995

U.S. Pat. No. 5,383,502

Patentee: Fisk et al.

Issue Date: Jan. 24, 1995

U.S. Pat. No. 5,200,787

Patentee: Nishiguchi

Issue Date: Apr. 6, 1993

U.S. Pat. No. 5,089,854

Patentee: Kaieda et al.

Issue Date: Feb. 18, 1992

U.S. Pat. No. 5,057,872

Patentee: Saijo et al.

Issue Date: Oct. 15, 1991

U.S. Pat. No. 4,990,964

Patentee: Kraehn

Issue Date: Feb. 5, 1991

U.S. Pat. No. 4,941,022

Patentee: Ohmura et al.

Issue Date: Jul. 10, 1990

U.S. Pat. No. 4,878,603

Patentee: Ikesue et al.

Issue Date: Nov. 7, 1989

The relevant portions of the foregoing disclosures may be briefly summarized as follows:

U.S. Pat. No. 5,495,323 discloses a device for storing a supply of particles for use in a developer unit of an electrophotographic printing machine. The device comprises an open ended container defining a chamber in communication with the open end thereof. The particles are stored in the chamber of the container. The device further comprises a puncturable seal attached to the open end of the container for sealing the chamber. The container is installable into the developer unit without removal of the seal.

U.S. Pat. No. 5,455,662 discloses a developer replenishing device for replenishing a developing device with a developer and a developer container for use therewith. The developer container or toner bottle has a mouth portion at one end thereof which is smaller than in diameter than a hollow cylindrical main body. At the end of the bottle provided with the mouth, a shoulder has the inner periphery thereof partly raised to the edge of the mouth portion to form a raised portion for scooping up toner.

U.S. Pat. No. 5,383,502 discloses an imaging material replenishing system including a toner container 12 removably insertable into an insertion guide member 16. The container 12 has a containment lid unit 20 which is automatically opened upon insertion. A lid latching member 30 which includes a lid latching notch 34 normally latches the containment lid to the container 12.

U.S. Pat. No. 5,200,787 discloses a developing unit 10 including a valve 40 at the junction of the first toner transport channel 27 and the second transport channel 30. The valve 40 is normally closed, but is opened when the toner collection bottle has been filled.

U.S. Pat. No. 5,089,854 discloses a device for assisting the removal of toner from a toner bottle. The device includes a vertically oriented toner bottle having an opening formed in a cap portion at its lower end and a bellows which may be extended or shrunk by pushing the top portion of the toner bottle downward to eject toner in the bottle out of the bottle.

U.S. Pat. No. 5,057,872 discloses a developer supplying device which includes a substantially cylindrical developer container having on its peripheral surface a spiral groove and being able to rotate to transport a developer therein by the groove. The device includes a supplying element in the form of an opening and a regulating device.

U.S. Pat. No. 4,990,964 discloses a toner delivery system including a toner bottle having an opening in the top end thereof. The toner is removed from the bottle by a vertically oriented suction spout to which a bellows is attacked for extracting the toner therefrom. A handle is located above the bellows and attached thereto to assist an operator in manually actuating the bellows U.S. Pat. No. 4,941,022 discloses a toner recovery device for collecting toner from a cleaning device into a recovered toner container 32. The recover opening 323 of the container 32 is covered with a shutter. The shutter is opened and closed by an operating lever 42.

U.S. Pat. No. 4,878,603 discloses a toner replenishing device for replenishing toner to a toner storage area, from where the toner is supplied to a developing section. The device includes a holder for releasably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position and receiving the first mating member.

According to the present invention, there is provided a plug for use in plugging an aperture in a container for storing a supply of particles for use in a developer unit of an electrophotographic printing machine. The plug includes a base, a rim extending from the periphery of the base. The rim may cooperate with the aperture. The plug further includes a stem extending from the base and spaced from the rim, so that the rim may conform to the aperture and thereby seal the aperture without being affected by the handle.

According to the present invention, there is also provided a container for storing a supply of particles for use in a developer unit of an electrophotographic printing machine. The container includes a body defining a chamber for storing particles therein. The body defines an aperture in the periphery thereof. The container also includes a plug for use in plugging the aperture. The plug includes a base and a rim extending from the periphery of the base. The rim may cooperate with the aperture. The plug further includes a stem extending from base and spaced from the rim, so that the rim may conform to the aperture and thereby seal the aperture without being affected by the handle.

According to the present invention, there is also provided a developer unit for developing a latent image recorded on an image receiving member with a supply of particles. The developer unit includes a container for storing a supply of particles for use in the developer unit. The container includes a body defining a chamber for storing particles therein. The body defines an aperture in the periphery thereof. The container also includes a plug for use in plugging the aperture. The plug includes a base and a rim extending from the periphery of the base. The rim may cooperate with the aperture. The plug further includes a stem extending from base and spaced from the rim, so that the rim may conform to the aperture and thereby seal the aperture without being affected by the handle.

According to the present invention, there is further provided an electrophotographic copy machine for developing with a supply of particles a latent image recorded on an image receiving member. The copy machine including a developer unit. The developer unit includes a container for storing a supply of particles for use in the developer unit. The container includes a body defining a chamber for storing particles therein. The body defines an aperture in the periphery thereof. The container also includes a plug for use in plugging the aperture. The plug includes a base and a rim extending from the periphery of the base. The rim may cooperate with the aperture. The plug further includes a stem extending from base and spaced from the rim, so that the rim may conform to the aperture and thereby seal the aperture without being affected by the handle.

IN THE DRAWINGS

Figure 1:
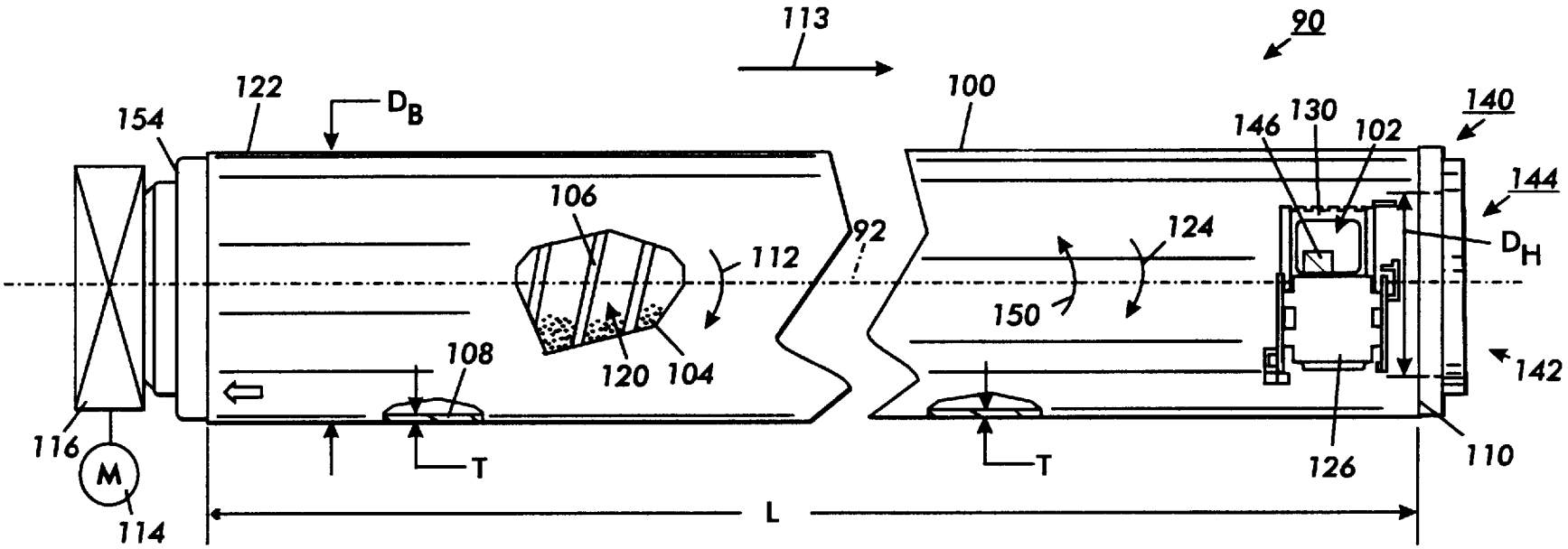
FIG. 1 is an plan view of a toner container utilizing an embodiment of the fill plug with uniform sealing capability according to the present invention with a drive tang for opening the toner dispensing door.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 15 printing machine will be shown hereinafter schematically and their operation described briefly with reference thereto.

For a general understanding of the features of the present invention, reference is made to the drawings. In the drawings, like reference numerals have been used throughout to designate identical elements. It will be evident from the following discussion that the present invention is equally well suited for use in a wide variety of printing systems, and is not necessarily limited in its application to the particular system shown.

Figure 14:
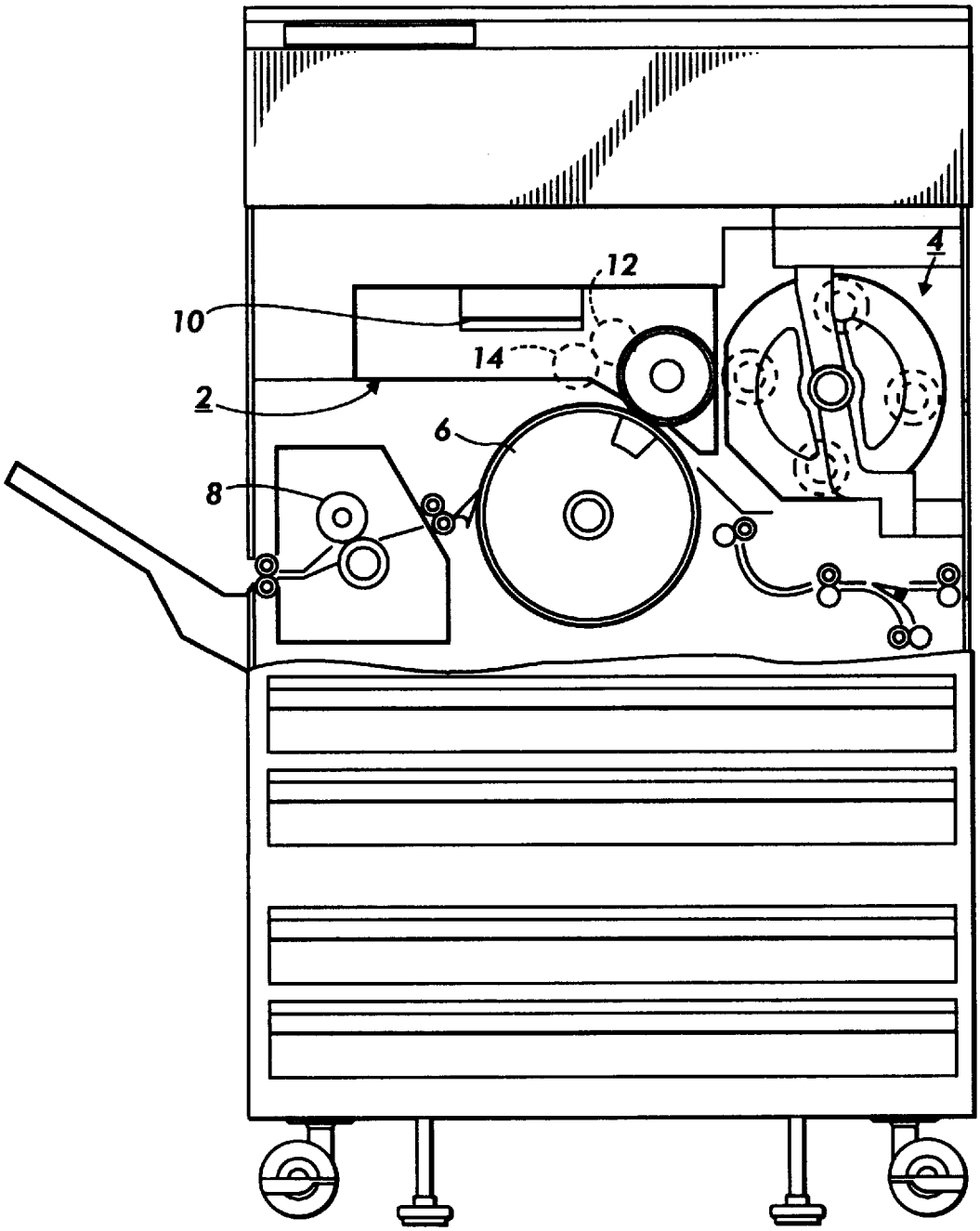
FIG. 14 is a plan view of an illustrative electrophotographic printing machine incorporating the toner container with uniform sealing plug of FIG. 1.
Figure 15:
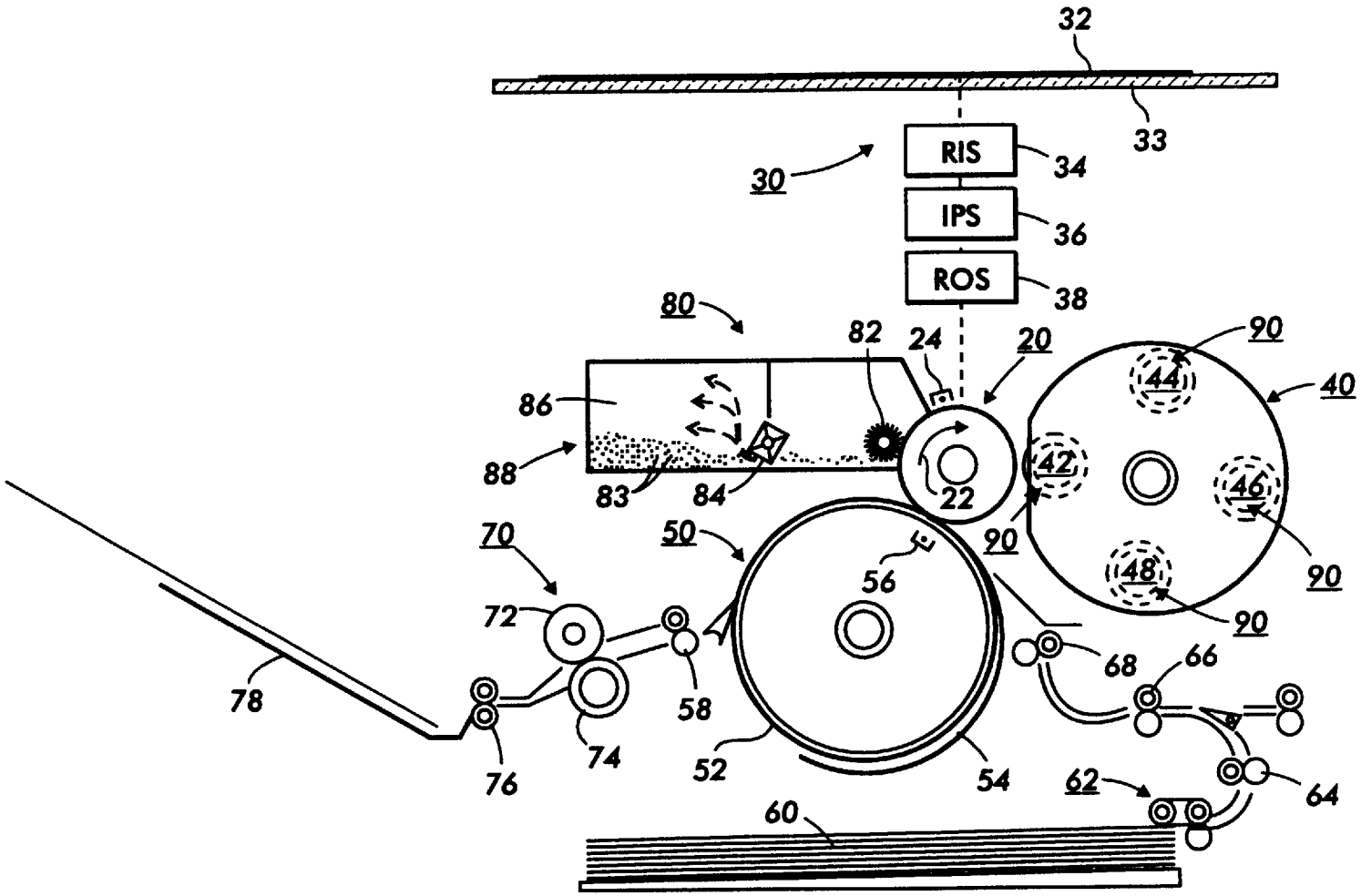
FIG. 15 is a schematic elevational view of the illustrative electrophotographic printing machine of FIG. 14.

Referring to FIGS. 14 and 15 of the drawings there is shown by way of example an automatic xerographic reproduction or printing machine, designated generally by the numeral 10 incorporating the press fit plug with uniform sealing of the present invention.

FIG. 14 shows the interior of a xerographic printing machine with a xerographic module 2, a developer unit 4, a transfer unit 6 and a fusing unit 8. Xerographic module 2 has handle 10, cleaner brush external gear 12 and toner moving member external gear 14, the external gears are attached to their respective elements as described below.

Referring now to FIG. 15, there is shown a schematic view of an electrostatographic or xerographic printing or copying machine employing a photoconductor 20. Photoconductor 20 moves in the direction of arrow 22 to advance successive portions of the surface sequentially through the various processing stations disposed about the path of movement thereof. Initially, a portion of photoconductor 20 passes through the charging station. At the charging station corona generating device 24 charges photoconductor 20 to a relatively high, substantially uniform potential.

Next, the charged photoconductor is rotated to the imaging station 30. At the imaging station, original document 32 is positioned on a transparent platen 33. Imaging station 30 also includes a raster scanning system which includes a raster input scanner (RIS) 34, an image processing system (IPS) 36 and a raster output scanner (ROS) 38. The RIS scans the original document one line at a time generating signals with each signal being representative of at least one color component in original document 32. The RIS captures the entire image from the original document 32 and converts it to a series of raster scan lines which are transmitted as electrical signals to IPS 36. The electrical signal from the RIS correspond to red, green and blue intensities at each point in the document. The IPS takes the red, green and blue signals and connects them to the proper cyan, magenta and yellow signals transmitted to ROS 38. The ROS illuminates the charged portion of the photoconductive surface to record four electrostatic latent images on the photoreceptor.

Figure 2:
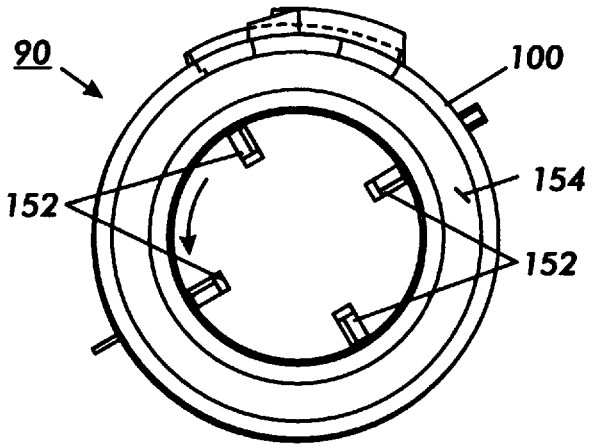
FIG. 2 is a first end view of the FIG. 1 toner container showing the drive tabs utilized for rotating the container auger.

After the electrostatic latent image has been recorded on photoconductor 20, the photoreceptor advances the electrostatic image to the development station 40. The development station includes four individual developer units generally indicated by the reference numerals 42, 44, 46 and 48. The developer units may be any kind of development unit. Developer units 42, 44, 46 and 48 respectively apply toner particles of magenta, yellow, cyan and black color. Each of the developer units is moved into and out of the operative position. In the operative position, the desired developer unit is moved to the adjacent the photoreceptor. In FIG. 2, developer unit 42 is shown in the operative position with developer units 44, 46 and 48 being in the non-operative position. Each of the developer units include a toner containing device 90 for containing a supply of the appropriate primary color or black toner.

After development, the toner image is moved to the transfer station 50 where the toner image is transferred to a sheet of support material 54. At the transfer station, the transfer roll 52, moves a sheet into contact with photoreceptor 20 . Transfer roll 52 electrostatically tacks the sheet of support material to its surface where the sheet may be retained for multiple transfers.

The sheet is advanced from a stack of sheets 60 disposed on a tray. A feeder roll mechanism 62 advances the sheet to vertical sheet transport rollers 64. The sheet continues along the paper path to pre-registration rollers 66 and registration rollers 68. These roller assemblies continue driving the sheet from the vertical transport, de-skew the sheet and release the sheet to the transport roll for image transfer. At the transfer zone, a corona generating device 56 puts a charge on the inside surface of the transfer roller so that the toner particles are attracted to the support material on the transfer roll. The sheet remains secured to the transfer roll 52 so as to move in a recirculating path for as many passes as colors developed. In this way, the cyan, yellow, magenta and black toner images are transferred to the sheet in superimposed registration with one another to form a multi-color copy of the colored original document.

After the last transfer operation, the sheet is released from transfer roll 52. Transport rollers 58 transport the sheet to the fusing station 70 where the transferred image is permanently fused to the sheet. The fusing station includes a heated fuser roll 72 and a pressure roll 74. The sheet passes through the nip defined by fuser roll 72 and pressure roll 74. The toner image contacts fuser roll 72 so as to be affixed to the sheet. Thereafter, the sheet is advanced by forwarding rollers 76 to catch tray 78. The last processing station in the direction of movement of photoreceptor 20, as indicated by arrow 22, is the cleaning station 80. The cleaning process takes place after each color is developed. A rotatably mounted fibrous cleaning brush 82 is positioned in the cleaning station and maintained in contact with photoreceptor 20 to remove residual toner particles 83 remaining after the transfer operation. Toner moving member 84 rotates to move toner collected by the fibrous brush into toner waste sump 86. The exit port 88 is located at the end board backside of the xerographic module.

It is believed that the foregoing description is sufficient for purposes of the present application to illustrate the general operation of an electrophotographic printing machine incorporating the development apparatus of the present invention therein.

Referring again to FIG. 15, a particle storage device 90 is shown. The particle storage device 90 is located within one of the developer unit 42, 44, 46 or 48 of the development station 40 and is secured to the respective developer unit. The particle storage device 90 is positioned relative to the horizontal such that longitudinal axis 92 of the device 40 is located horizontally. The horizontal orientation of the storage device 40 is particularly well suited for copying large documents.

Referring now to FIG. 1, the device 90 includes a container 100 defining an aperture 102 in the form of an opening through which developer material 104 including at least marking particles is dispensed.

The container 100 may have any suitable shape and configuration capable of containing the developer material 104. For example, the container 100 may have a generally cylindrical shape and contain within the hollow container 100 a spirally shaped spring or auger 106 for urging the developer material 104 within the container 100 toward the developer units 42, 44, 46 and 48 (see FIG. 15).

Referring again to FIG. 1, the container 100 may be supported by supports (not shown) in the form of a V or similarly shaped cradle. The container 100 may thus be replaced by lifting the container 100 in a vertical direction away from the cradle.

The spirally shaped spring or auger 106 is located within the periphery 108 of the container 100 urge the material 104 toward dispensing end 110 of the container 100. The spirally shaped spring or auger 106 is rotated in the direction of arrow 112 whereby the spirally shaped spring or auger 106 progress the material 104 in the direction of arrow 113. The spirally shaped spring or auger 106 is rotated by any suitable device for example a drive motor 114 or by a common motor (not shown) connected to the spirally shaped spring or auger 106 by a drive train (not shown). The drive motor 114 may be connected to the spirally shaped spring or auger 106 by any suitable method.

The container 100 may have any suitable size necessary to store a sufficient quantity of developer material 104 within chamber 120 of the container 100. For example, the container 100 may have a length L of approximately 13 inches and a diameter $D_B$ across the external periphery 122 of the container 100 of approximately 2¾ inches.

The container 100 may be made of any suitable durable material and may, for example, be made of acetyl or polyethylene. The container 100 may likewise be made of a glass filled polycarbonate for increased strength. When made of acetyl or polyethylene, the container 100 may have a thickness T sufficient to maintain the strength of the container 100, for example, the thickness T may be approximately 0.020 to 0.050 inches.

The container 100 may be made by any suitable method, for example, the container 100 may be injection molded by any suitable injection molding process.

To permit the material 104 to exit the container 100, the container 100 includes the dispensing opening 102 from which the material 104 is dispensed from the container 100. The opening 102 may have any suitable shape, for example, include a round aperture or square or rectangular aperture. The cross sectional area of the opening 102 is selected to provide for the proper amount of material 104 to be distributed from the container depending on the need of the copy machine (not shown). The opening 102 is preferably located on periphery 122 of the dispensing end 110 of the container 100. The container 100 may be integrally molded or may be fabricated from a paper tube.

With each rotation of the container 100, in the direction of arrow 124, the opening 102 moves from an opening upward toward an opening downward position and back to an opening upward position. With each rotation of the container 100, the opening thus cycles about the periphery 122 of the container 100 permitting a defined amount of material 104 to be dispensed from the container 100.

To provide for covering the opening 102 during shipment, storage and installation, the container 100 includes a closure 126 in the form of for example a sliding door. The door 126 matingly fits with outer periphery 122 of the dispensing end 110 of the container 100. The closure or cover portion 126 thus includes an inner periphery which mates with the outer periphery 122 of the dispensing end 110 of the container 100. The inner periphery is defined by a diameter which is slightly larger than diameter $D_B$ defining the outer periphery 122 of the dispensing end 110 of the container 100. A door seal 130 made of a suitable durable resilient material, for example a resilient foam, for example polypropylene, may be located around the opening 102 to ensure an adequate seal of the door 126 during shipment.

While it may preferable to not have a temporary seal, the device 90 may include a temporary seal (not shown) for sealing the material 104 within the container 100 during shipment. The container 100 may have the opening 102 at the dispensing end 110 covered by a removable cover seal (not shown) adhesively applied to the container 100. The cover seal may be made of any suitable material that is preferably gas permeable. For example, TYVEC®, a product of E.I. dupont de Nemours and Company, is suitable for this purpose.

According to the present invention and referring again to FIG. 1, the device 90 includes a plug 140 with a uniform sealing ability. The plug 140 is utilized to seal fill opening 142 located in dispensing end 110 of the container 100. The plug 140 preferably includes a handle 144 which is utilized to rotate the container 100 in the direction of rotation 150. The door 126 contacts stop 146 of the developer unit such that by rotating the container 100 in the direction of arrow 150, the door 126 is moved from a position over the dispense opening 102 to its opened position as shown in FIG. 1.

Referring now to FIG. 2 the container 100 is shown with drive tabs 152 pointing outwardly from drive end 154 of the container 100. The drive tabs 152 serve to cooperate with drive adapter 116 of FIG. 1 in order that the auger 106 be rotated.

Figure 3:
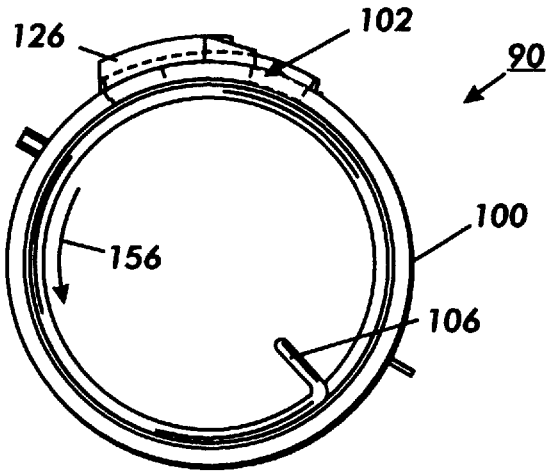
FIG. 3 is a second end view of the FIG. 1 toner container with the fill plug removed showing the container auger.

Referring now to FIG. 3 the device 90 is shown with the plug 140 removed from the container 100. The drive tabs 152 of FIG. 2 are utilized to rotate the wire auger 106 in the direction of arrow 156 such that the toner is advanced in the direction of arrow 113.

Figure 4:
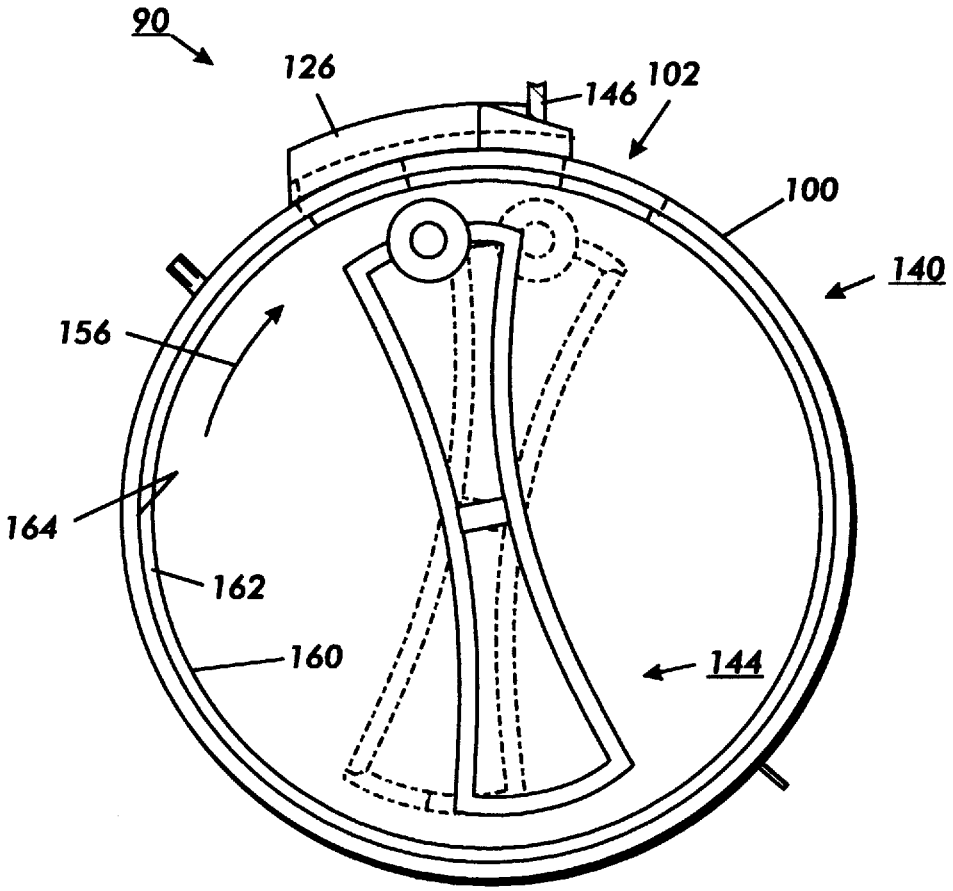
FIG. 4 is a third end view of the FIG. 1 toner container utilizing a fill plug with uniform sealing capability and with a drive tang according to the present invention.

Referring now to FIG. 4 the plug 140 is shown installed onto the container 100. The handle 144 is shown in solid in the container loading position as the container 100 is installed with the opening 102 covered by door 126. As the handle 144 is rotated in the direction of arrow 156 the handle 144 moves from its position shown in solid to that shown in phantom in FIG. 4. The rotation of the handle 144 causes the container 100 to rotate in a similar direction causing the opening 102 to likewise rotate in the direction of arrow 156. The door 126 is restrained by stop 146 causing the opening 102 to be exposed permitting toner to be removed from the container 100.

Referring again to FIG. 4 the handle 144 is spaced from internal periphery 160 of the plug 140. Rim 162 of the plug 140 thus uniformly contacts internal periphery 164 of the container 100 providing uniform and efficient sealing of the plug 140 onto the container 100.

Figure 5:
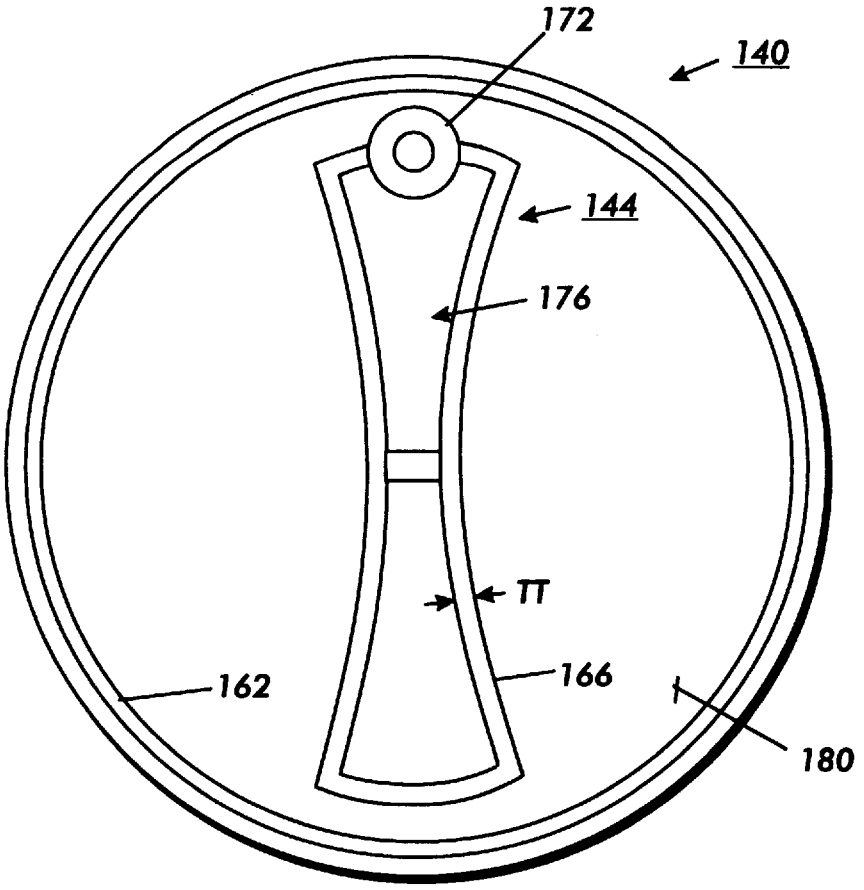
FIG. 5 is a plan view of the fill plug utilized in the FIG. 1 toner container.

Referring now to FIG. 5 the plug 140 is shown in greater detail. The plug 140 includes the handle 144. The handle 144 is centrally located, preferably on plug 140 and is spaced from rim 162 of the plug 140. The handle 144 to minimize its weight, has a hollow structure and includes a peripheral wall 166.

The plug, in order to ensure adequate sealing with the opening to be plug, is preferably made of a material that has added strength than low density polyethylene or polypropylene. Such a material with greater strength than low density polyethylene or polypropylene is the plastic material of polystyrene.

The outer wall 166 has a thickness TT of approximately 0.05 inches. It should be appreciated that the thickness TT may be varied to obtain the proper strength of the wall 166. The walls 166 form a core or cavity 176 within the walls 166. To properly orient the position of the handle 144 with respect to the container 90, preferably, the plug 140 includes a feature in the form of an identifying mark 172. For simplicity, the identifying mark 172 may be positioned on the handle 144. As shown in FIG. 5, the identifying mark 172 is in the form of a hollow cylinder.

To assure uniform flexing and correspondingly uniform sealing, the rim 162 of the plug 140 extends outwardly from end face 180 of the plug 140. End face 180 is preferably planar and the handle 144 extends outwardly from end face 180. The cavity 176 thus also extend outwardly from end face 180. Therefore, end face 180 has a uniform planar cross section such that the deflection of the rim 162 may be uniform about the circumference of the rim 162.

Figure 6:
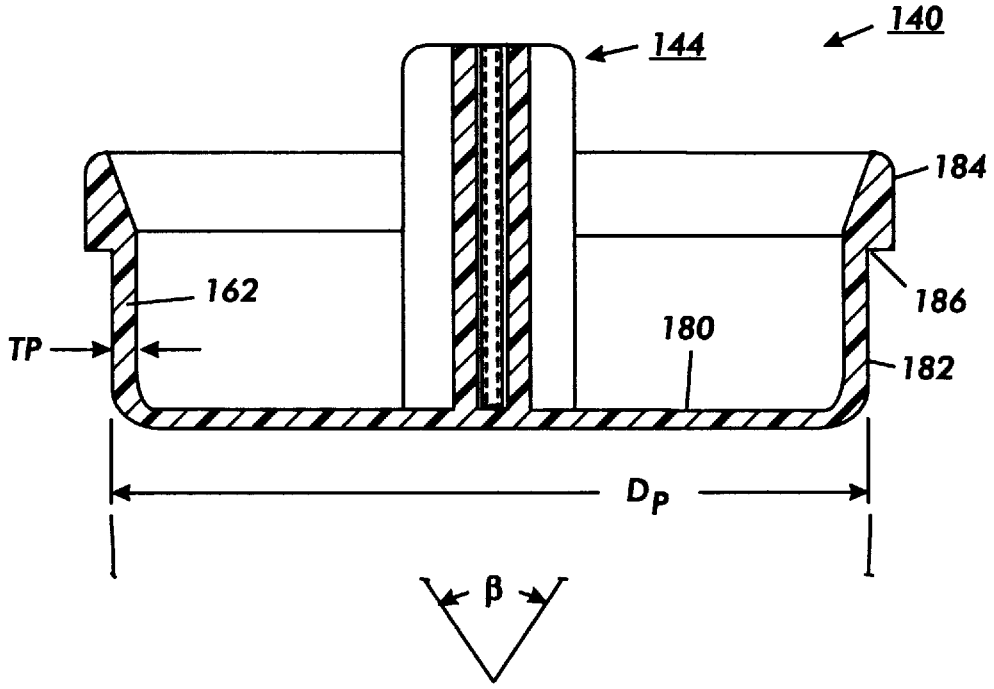
FIG. 6 is a cross sectional view of FIG. 5 along the line 6—6 in the direction of the arrows.

Referring now to FIG. 6, the plug 140 is shown in cross section. As can be seen from FIG. 6, the end face 180 of the plug 140 has a uniform cross section. Furthermore, rim 162 extends upwardly from end face 180 and likewise has a uniform and concentric cross section. To provide additional strength for the plug 140, preferably, the plug 140 includes a ring 184 extending upwardly from handle end 186 of rim 162 of plug 140. Outer periphery 182 of rim 162 preferably has a diameter $D_P$ of, for example, 1.7 inches. The fill opening 142 has an inner diameter $D_H$ (see FIG. 1) which is substantially equal to diameter $D_P$ of the periphery 182 of the plug 180. The rim 162 of the plug 140 has a thickness TP chosen to provide the strength and resiliency to properly seal the fill opening 142. For example the thickness TP may have a thickness of 0.05 inches. To assist sealing, preferably the periphery 182 of the rim 162 of the plug 140 is tapered and forms an included angle $\beta$ of, for example, 5 degrees.

Figure 7:
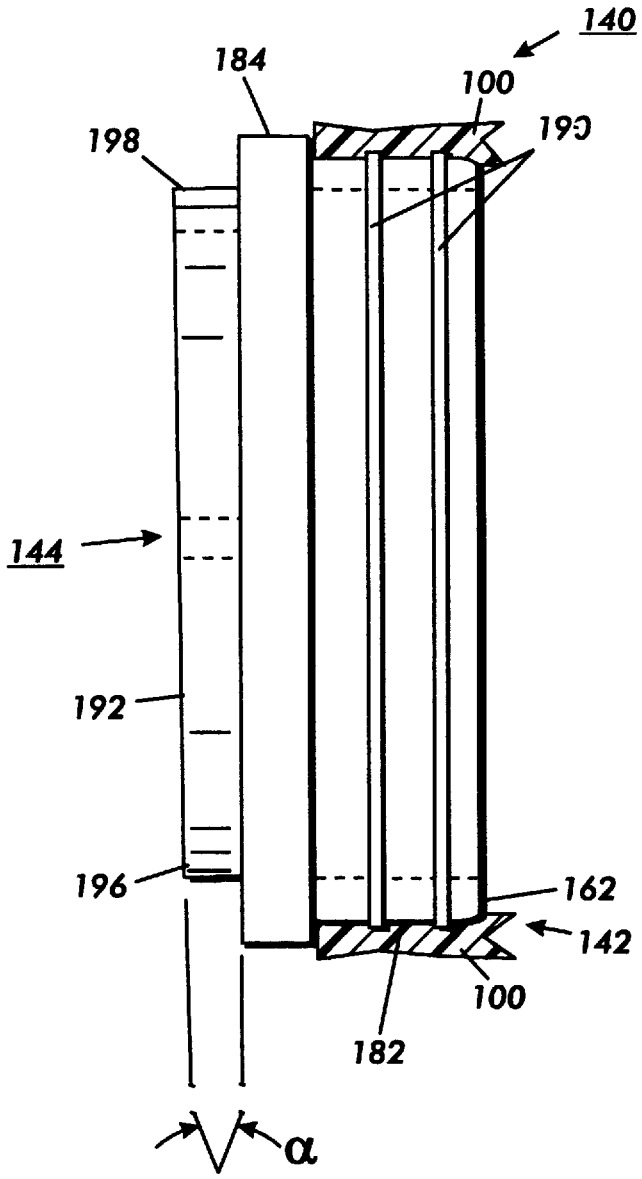
FIG. 7 is an end view of the FIG. 5 fill plug.

Referring now to FIG. 7, the outer periphery 182 of the plug 140 is shown in greater detail. The outer periphery 182 of the rim 162 of the plug 140 preferably includes a rib 190 for improving the seal of the plug 140 with the fill opening 142.

preferably, the handle 144 extends outwardly beyond upper face 194 of ring 184 of the plug 140.

To improve the ability of the plug 140 to be oriented automatically by automated assembly equipment into the container 100, preferably, the handle 144 includes a feature for permitting automated orientation of the handle 144. One example of providing such an automation feature to the handle 144 is in the form of a tapered outer face 192 of the handle 144. The outer face 192 may for example have a taper from its narrow point 196 to its wide portion 198 forming an angle with the outer face 194 of the ring 184 defined by angle $\alpha$.

It should be appreciated that a press fit fill plug with uniform sealing ability as claimed in the present invention, may be utilized with the handle. Furthermore, it should be appreciated that the invention relates to a plug including a handle, as well as, to a plug without a handle.

Figure 8:
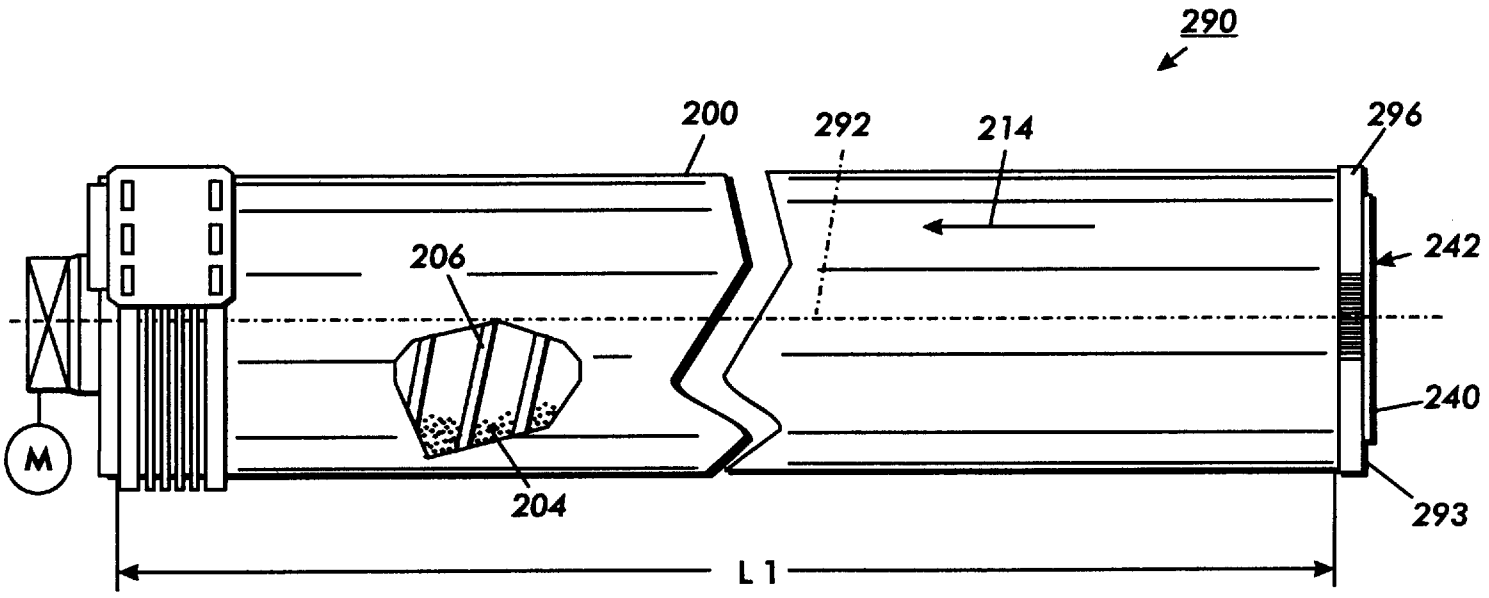
FIG. 8 is an plan view of another toner container utilizing a second embodiment of the fill plug with uniform sealing capability according to the present invention without a drive tang.

For example, referring now to FIG. 8, the press fit plug with uniform sealing ability may be in the form of a plug 240 for use in a storage device 290. Storage device 290 is similar to storage device 90 except that rather than having plug 140 including a handle, the plug 240 does not include a handle for rotating the storage device 290. Rather, the storage device 290 includes feature 296 secured to container 200 for rotating the container 200. The container 200 rotates along centerline 292 and toner particles 204 are advanced by a helical wire 206 in the direction of arrow 214. To provide for filling of the container 200 with particles, the container 200 includes an opening 242 in fill end 293 of the container 200. The plug 240 is used to seal opening 242 during shipment and storage.

Figure 9:
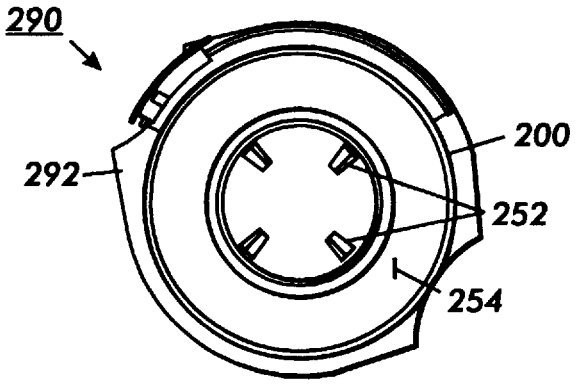
FIG. 9 is a first end view of the FIG. 8 toner container showing the drive tabs utilized for rotating the container auger.

Referring now to FIG. 9, the container 200 includes a feature in the form of drive tabs 252 located on drive end 254 of the container 200 and utilized to rotate the wire auger 206 to advance the particles in the direction of arrow 214.

Figure 10:
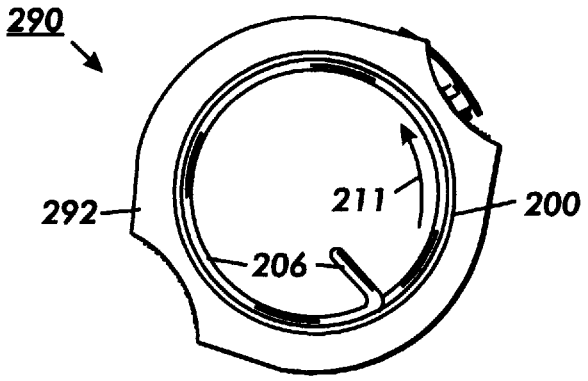
FIG. 10 is a second end view of the FIG. 8 toner container with the fill plug removed showing the container auger.

Referring now to FIG. 10, the fill end 292 of the container 200 is shown with the plug 240 removed. The wire auger 206 rotates in the direction of arrow 211 to advance the marking particles in the direction of arrow 214 (see FIG. 9).

Figure 11:
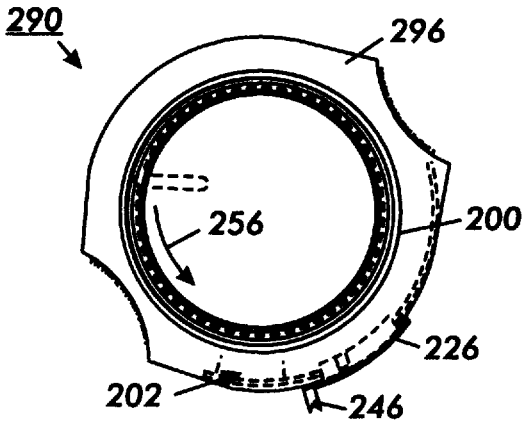
FIG. 11 is another second end view of the FIG. 8 toner container with the fill plug installed.

Referring now to FIG. 11, the container 200 includes door 226 for sealing opening 202. Tabs 296 are used to rotate container 200 in the direction of arrow 256 such that the door 226 is held in position by stop 246 to provide for the opening 202 to be exposed as shown in phantom in FIG. 11.

Figure 12:
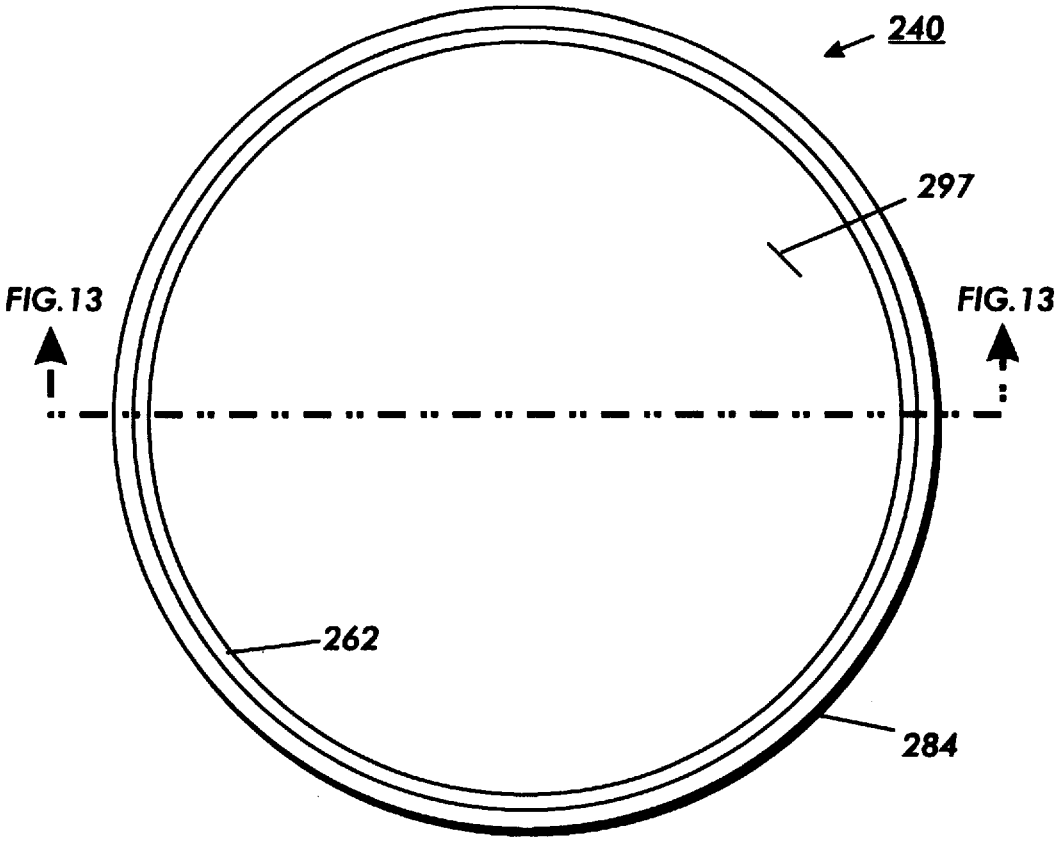
FIG. 12 is a plan view of the fill plug utilized in the FIG. 8 toner container.

Referring now to FIG. 12, the plug 240 is shown in greater detail. The plug 240 includes an end face 297 from which rim 262 extends. To increase the strength of the rim 262, preferably, the plug 240 further includes a ring 284 which extends from the open end of rim 262.

Figure 13:
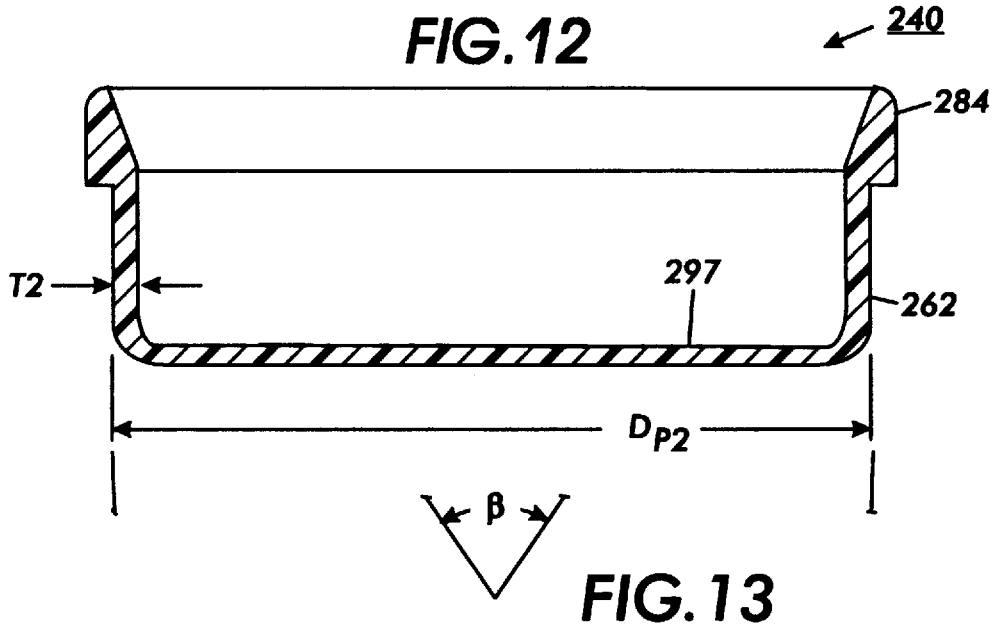
FIG. 13 is a cross sectional view of FIG. 12 along the line 13—13 in the direction of the arrows.

Referring now to FIG. 13, the plug 240 is shown in cross section. The plug 240 preferably has a thickness T2 approximately equal to the thickness TP of plug 140 of FIG. 6. The plug 240 is preferably made of a similar material to that of plug 140 of FIG. 6, in order to ensure adequate sealing with the opening to be plug. The plug 240 is preferably made of a material that has greater strength than low density polyethylene or polypropylene. Such a material with greater strength than low density polyethylene or polypropylene is polystyrene.

For example, for sealing an opening 242 with a diameter $D_{H2}$ of approximately 1.7 inches, the plug 240 has a diameter $D_{P2}$ of approximately 1.7 inches. The plug 240 is preferably tapered in a similar fashion to that of plug 140 of FIG. 6. The plug 240 is preferably made of a material of sufficient strength and thickness to adequately seal the opening 242. The applicants have found that a plastic plug made of polystyrene to be particularly effective in sealing and opening 242.

By providing a press fit fill plug with uniform sealing ability a plug may be provided that seals an opening without having toner leaking through it.

By providing a press fit fill plug made of polystyrene a plug may be provided that has adequate strength to prevent toner from leaking through the opening that the plug is intended to seal.

By providing a press fit fill plug with uniform sealing ability and a handle for rotating the plug, a plug may be provided which will transfer torque to the bottle and simultaneously adequately seal the opening of the container.

By providing a press fit fill plug with a handle spaced from the rim of the plug, a plug may be provided with uniform flexing ability of the rim. The uniform flexing of the rim will provide uniform sealing and a leak free plugging of an opening in a container.

By providing a press fit fill plug with a handle which is cored from the handle end of the handle, a plug may be provided with a uniform flexing ability. The uniform flexing ability will provide for uniform sealing and a leak free sealing of an opening in a container.

By providing a press fit fill plug including a tapered handle outer face, a plug may be provided which may be oriented automatically without the intervention of an operator.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A plug for use in plugging an aperture in a container for storing a supply of particles for use in a developer unit of an electrophotographic printing machine, the plug comprising:

a base;

a rim extending from the periphery of said base, said rim comparable with said aperture; and a stem extending from base and spaced from said rim, so that said rim may conform to the aperture and thereby seal the aperture without being affected by said stem.

2. A plug according to claim 1, wherein the said plug comprises a plastic.

3. A plug according to claim 2, wherein the said plug comprises polystyrene.

4. A plug according to claim 1, wherein the said base is round.

5. A plug according to claim 1, wherein the distal end of said stem and the base form an acute angle therebetween of at least 3 degrees, to assist in assembly of said plug into the aperture of said container.

6. A plug according to claim 1, wherein said plug is cored from the stem side of said plug.

7. A plug according to claim 1, wherein said stem is hollow.

8. A plug according to claim 1, wherein the said stem includes a plurality of circumferential ribs extending from the external periphery thereof.

9. A container for storing a supply of particles for use in a developer unit of an electrophotographic printing machine, the container comprising:

a body defining a chamber for storing particles therein, said body defining an aperture in the periphery thereof; and a plug for use in plugging the aperture, the plug including a base, a rim extending from the periphery of said base, said rim comparable with said aperture, and a stem extending from base and spaced from said rim, so that the rim may conform to the aperture and thereby seal the aperture without being affected by the handle.

10. A container according to claim 9, wherein the said plug comprises a plastic.

11. A container according to claim 10, wherein the said plug comprises polystyrene.

12. A container according to claim 9, wherein the said base is round.

13. A container according to claim 9, wherein the distal end of said stem and the base form an acute angle therebetween of at least 3 degrees, to assist in assembly of said plug into the aperture of said container.

14. A container according to claim 9, wherein said plug is cored from the stem side of said plug.

15. A container according to claim 9, wherein said stem is hollow.

16. A container according to claim 9, wherein the said stem includes a plurality of circumferential ribs extending from the external periphery thereof.

17. A developer unit for developing a latent image recorded on an image receiving member with a supply of particles, the developer unit including a container for storing a supply of particles for use in the developer unit, said container comprising:

a body defining a chamber for storing particles therein, said body defining an aperture in the periphery thereof; and a plug for use in plugging the aperture, the plug including a base, a rim extending from the periphery of said base, said rim comparable with said aperture, and a stem extending from base and spaced from said rim, so that the rim may conform to the aperture and thereby seal the aperture without being affected by the handle.

18. A developer unit according to claim 17, wherein the said plug comprises a plastic.

19. A developer unit according to claim 18, wherein the said plug comprises polystyrene.

20. A developer unit according to claim 17, wherein the said base is round.

21. A developer unit according to claim 17, wherein the distal end of said stem and the base form an acute angle therebetween of at least 3 degrees, to assist in assembly of said plug into the aperture of said container.

22. A developer unit according to claim 17, wherein said plug is cored from the stem side of said plug.

23. A developer unit according to claim 17, wherein said stem is hollow.

24. A developer unit according to claim 17, wherein the said rim includes a plurality of circumferential ribs extending from the external periphery thereof.

25. An electrophotographic printing machine for developing with a supply of particles a latent image recorded on an image receiving member, said copy machine including a developer unit, the developer unit including a container for storing a supply of particles for use in the developer unit, said container comprising:

a body defining a chamber for storing particles therein, said body defining an aperture in the periphery thereof; and a plug for use in plugging the aperture, the plug including a base, a rim extending from the periphery of said base, said rim comparable with said aperture, and a stem extending from base and spaced from said rim, so that the rim may conform to the aperture and thereby seal the aperture without being affected by the handle.

* * * * *